US009062477B2

(12) United States Patent
Da Deppo et al.

(10) Patent No.: US 9,062,477 B2
(45) Date of Patent: Jun. 23, 2015

(54) VEHICULAR DOOR HANDLE ASSEMBLY WITH INERTIAL SECONDARY CATCH POSITION

(71) Applicant: Huf North America Automotive Parts Mfg. Corp., Milwaukee, WI (US)

(72) Inventors: Lynn D. Da Deppo, Bloomfield Hills, MI (US); Ehab Kamal, Novi, MI (US)

(73) Assignee: Huf North America Automotive Parts Mfg. Corp., Milwaukee, WI (US)

( * ) Notice: Subject to any disclaimer, the term of this patent is extended or adjusted under 35 U.S.C. 154(b) by 78 days.

(21) Appl. No.: 13/687,131

(22) Filed: Nov. 28, 2012

(65) Prior Publication Data

US 2014/0145454 A1 May 29, 2014

(51) Int. Cl.

| | |
|---|---|
| ***E05B 3/00*** | (2006.01) |
| ***E05B 77/06*** | (2014.01) |
| *E05C 3/06* | (2006.01) |
| *E05B 85/16* | (2014.01) |

(52) U.S. Cl.
CPC ..... *E05B 77/06* (2013.01); *Y10T 292/57* (2015.01); *E05B 85/16* (2013.01)

(58) Field of Classification Search
CPC ..... E05B 5/00; E05B 77/06
USPC ..... 292/336.3, 198, 200, DIG. 22, DIG. 30, 292/DIG. 65; 16/110.1
See application file for complete search history.

(56) References Cited

U.S. PATENT DOCUMENTS

| | | | | |
|---|---|---|---|---|
| 3,719,248 | A * | 3/1973 | Breitschwerdt et al. | 180/271 |
| 5,092,642 | A * | 3/1992 | Lindmayer et al. | 292/336.3 |
| 5,669,642 | A * | 9/1997 | Kang | 292/336.3 |
| 6,007,122 | A * | 12/1999 | Linder et al. | 292/336.3 |
| 6,709,033 | B2 * | 3/2004 | Jooss et al. | 292/336.3 |
| 7,070,216 | B2 * | 7/2006 | von zur Muehlen | 292/336.3 |
| 7,152,893 | B2 * | 12/2006 | Pudney | 292/336.3 |
| 7,600,795 | B2 * | 10/2009 | Cummins et al. | 292/336.3 |
| 7,677,614 | B2 * | 3/2010 | Monig | 292/336.3 |
| 8,029,032 | B1 * | 10/2011 | Yang | 292/336.3 |
| 8,322,077 | B2 * | 12/2012 | Papanikolaou et al. | 49/460 |
| 8,366,159 | B2 * | 2/2013 | Patel | 292/336.3 |
| 8,376,424 | B2 * | 2/2013 | Bejune | 292/336.3 |
| 8,424,936 | B2 * | 4/2013 | Muller et al. | 292/336.3 |
| 8,485,570 | B2 * | 7/2013 | Konchan | 292/194 |
| 2005/0057049 | A1 * | 3/2005 | Choi | 292/336.3 |
| 2005/0161959 | A1 * | 7/2005 | Belchine, III | 292/336.3 |

(Continued)

FOREIGN PATENT DOCUMENTS

DE 102009044042 A1 3/2011

*Primary Examiner* — Carlos Lugo
*Assistant Examiner* — Faria Ahmad
(74) *Attorney, Agent, or Firm* — Quarles & Brady LLP

(57) ABSTRACT

A vehicle outer door handle assembly includes a base, a latch release mechanism, and an inertial catch. The latch release mechanism includes a countermass assembly with a primary catch point and a secondary catch point, and the latch release mechanism and the counterassembly rotate between a rest position and an active position in response to movement of a door handle. The inertial catch includes a blocking shoulder and rotates from an unblocking position to a blocking position in response to inertia forces acting upon the inertial catch. When the inertial catch is in its blocking position, it prevents the countermass assembly from rotating into its active position by the blocking shoulder engaging the primary catch point or the secondary catch point.

18 Claims, 5 Drawing Sheets

(56) References Cited

U.S. PATENT DOCUMENTS

| | | | | |
|---|---|---|---|---|
| 2008/0036219 | A1* | 2/2008 | Savant et al. | 292/336.3 |
| 2011/0115240 | A1* | 5/2011 | Muller et al. | 292/336.3 |
| 2013/0147211 | A1* | 6/2013 | Lee et al. | 292/198 |
| 2013/0221690 | A1* | 8/2013 | Rocci et al. | 292/336.3 |
| 2013/0234455 | A1* | 9/2013 | Rocci et al. | 292/336.3 |
| 2013/0276375 | A1* | 10/2013 | Carmona et al. | 49/460 |
| 2013/0285390 | A1* | 10/2013 | Jankowski et al. | 292/199 |
| 2014/0084603 | A1* | 3/2014 | Bejune et al. | 292/198 |

* cited by examiner

VEHICULAR DOOR HANDLE ASSEMBLY WITH INERTIAL SECONDARY CATCH POSITION

CROSS REFERENCE TO RELATED APPLICATIONS

None.

STATEMENT REGARDING FEDERALLY SPONSORED RESEARCH

Not Applicable.

BACKGROUND OF THE INVENTION

The present invention relates to an outer door handle assembly for a motor vehicle. More specifically, the present invention relates to a locking mechanism of an outer door handle assembly for preventing door latch release during crash-induced door handle movement.

Motor vehicles include at least one outer door handle for releasing a door latch mechanism in order to open a vehicle door. Typically, a user actuates the outside door handle by activating a handle portion relative to a base. The handle portion may, however, also be activated when the outside door handle experiences a high inertia force, such as that caused by a vehicle crash. The movement of the handle portion relative to the base in response to the high inertia force can cause inadvertent unlatching and resultant opening of the door. This is undesirable during crashes because closed doors provide benefits, including containing the occupant within the vehicle during the crash event.

In recent years, locking mechanisms have been developed in an attempt to prevent opening of a vehicle door in the event of high inertia forces. While these locking mechanisms are useful for some crash situations, vehicle crashes involving high acceleration impact or vehicle rollover can result in forces that could overcome the locking mechanisms. It would be therefore desirable to provide additional robustness to locking mechanisms to prevent vehicle door opening during such vehicle crash events.

SUMMARY OF THE INVENTION

The present invention provides a locking mechanism for an outer door handle assembly that includes primary and secondary catch points for blocking activation of a latch release mechanism during a vehicle crash. The primary catch point generally ensures that inertial-induced forces from a vehicle crash do not result in inadvertent activation of the latch release mechanism. However, some inertial and/or deformation-induced forces, such as those caused by high-acceleration impact or rollover crash events, may cause the locking mechanism to bypass the primary catch point. If the primary catch point is bypassed, the secondary catch point still ensures that such inertial-induced forces do not result in inadvertent activation of the latch release mechanism.

A general objective of the present invention is to provide an outer door handle assembly for a vehicle including a base, a latch release mechanism, and an inertial catch. The latch release mechanism includes a countermass assembly with a primary catch point and a secondary catch point, and the latch release mechanism and the counterassembly rotate about a first shaft coupled to the base between a rest position and an active position in response to movement of a door handle. The inertial catch includes a blocking shoulder and rotates about a second shaft coupled to the base from an unblocking position to a blocking position in response to inertia forces acting upon the inertial catch. The inertial catch prevents the countermass assembly from rotating into its active position by the blocking shoulder engaging the primary catch point or the secondary catch point when the inertial catch is in its blocking position.

According to another objective of the present invention, a locking mechanism for a door handle assembly includes a countermass assembly and an inertial catch. The countermass assembly includes a primary catch point and a secondary catch point, and rotates between a rest position and an active position. The inertial catch includes a blocking shoulder and rotates between an unblocking position and a blocking position. The inertial catch is positioned relative to the countermass assembly so that, when the inertial catch is rotated to its blocking position, the inertial catch prevents the countermass assembly from rotating into its active position.

This and still other objectives and advantages of the present invention will be apparent from the description which follows. In the detailed description below, preferred embodiments of the invention will be described in reference to the accompanying drawing. These embodiments do not represent the full scope of the invention. Rather the invention may be employed in other embodiments. Reference should therefore be made to the claims herein for interpreting the breadth of the invention.

DETAILED DESCRIPTION OF PREFERRED EMBODIMENTS

Figure 1:
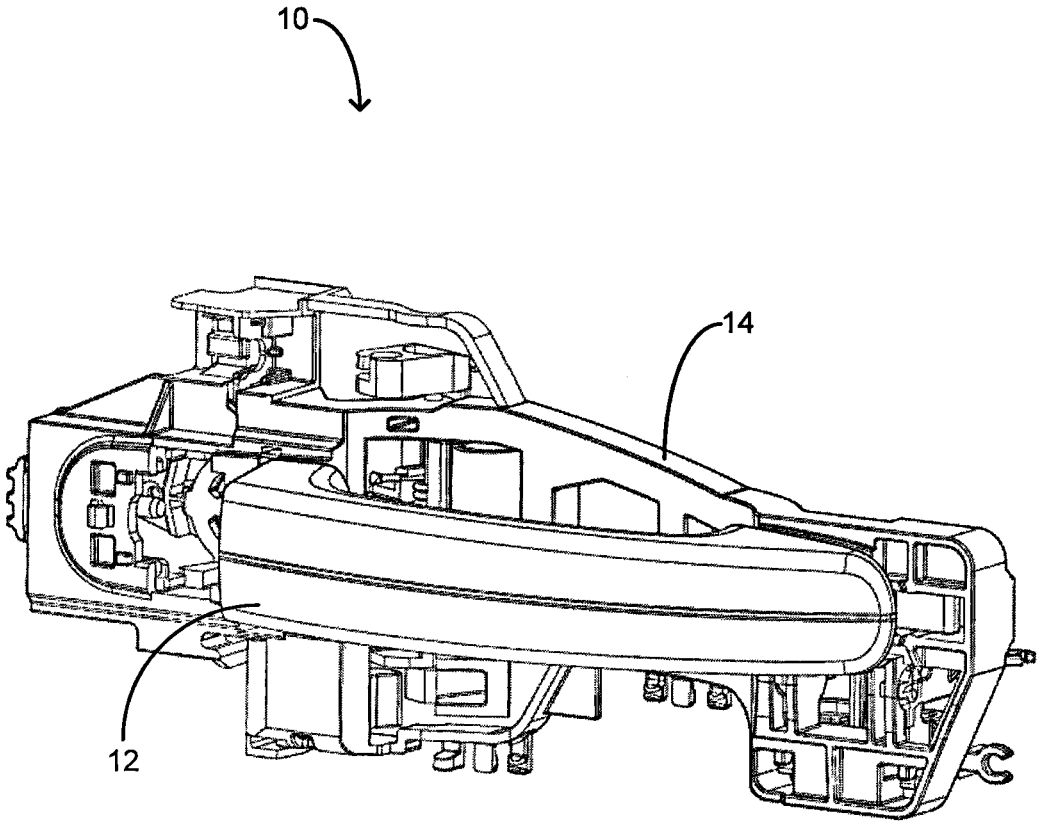
FIG. 1 is a perspective front view of a vehicle door handle assembly.
Figure 2:
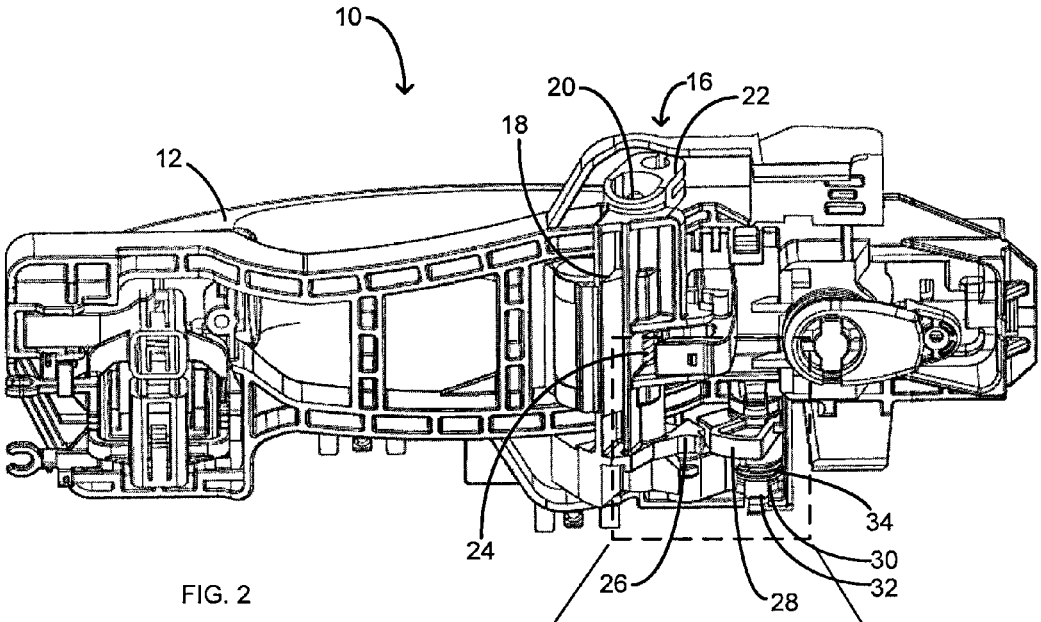
FIG. 2 is a perspective rear view of a vehicle door handle assembly in a rest position and FIG. 2A is a detailed view of an area outlined by the dashed box in FIG. 2.

The present invention provides a vehicle outer door handle assembly with a latch release mechanism that includes primary and secondary catch points to prevent unintentional opening of the vehicle door in the event of a vehicle crash. During some crash events, forces cause a countermass assembly and an inertial block of the vehicle door handle assembly to move relative to each other so that the countermass assembly and the inertial block contact each other at the primary catch point to prevent actuation of the latch release mechanism. During other crash events, however, forces may cause the countermass assembly to move relative to the inertial mass in a way that bypasses the primary catch point contact. Although this primary catch point contact is bypassed, the countermass assembly and the inertial block still contact each other at the secondary catch point to prevent actuation of the latch release mechanism FIG. 1 illustrates a vehicle outer door handle assembly 10, according to the present invention, including a door handle 12 and a base 14. The door handle assembly 10 is installed within a vehicle door, or tailgate, so that the base 14 is set within the door and the door handle 12 extends outward from the door to allow user access to the door handle 12. The door handle 12 can be pulled or rotated away from the base 14 by a user (i.e., rotated from a rest position, as shown in FIG. 1, to an active position) to actuate or rotate a latch release mechanism 16 from a rest position, as shown in FIG. 2, to an active position (not shown). When in the rest position, the latch release mechanism 16 prevents the door from being opened, for example by maintaining door latch mechanisms in place between the door and the vehicle frame. When in the active position, the latch release mechanism 16 allows the door to be opened, for example by releasing the door latch mechanisms.

As shown in FIG. 2, the latch release mechanism 16 includes a transfer lever 18 that rotates the latch release mechanism 16 about a shaft 20 coupled to the base 14 (i.e., via bearings 22) in response to rotation of the door handle 12, either via a direct mechanical coupling between the two components 12, 16 or an indirect coupling through a cable. A torsion spring 24 normally holds the transfer lever 18, the latch release mechanism 16, and the door handle 14, in their rest positions, as shown in FIG. 2. Thus, the spring force of the torsion spring 24 must be overcome to rotate the components 12, 16, 18 into their active positions to allow opening of the door. This spring force is small enough to be overcome by a user pulling the door handle 12, but large enough to normally keep the components 12, 16, 18 in their rest positions and to rotate the components 12, 16, 18 back to their rest positions after a user releases the door handle 12, thus preventing inadvertent unlatching/opening of the door.

Figure 2A:
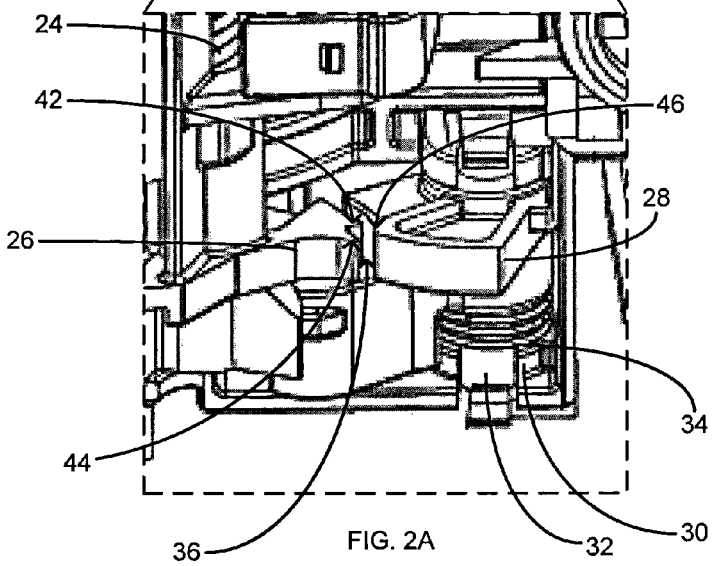
Figure 3:
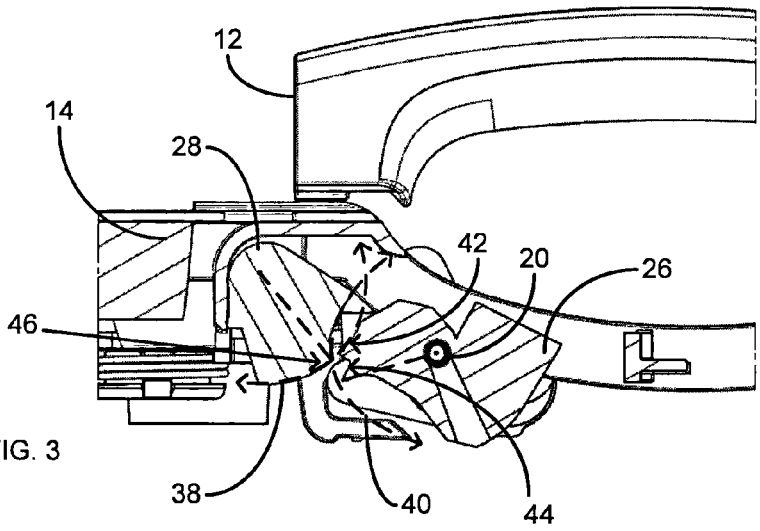
FIG. 3 is an underside view of an inertial catch and a countermass assembly of the vehicle door handle assembly of FIG. 2.
Figure 7:
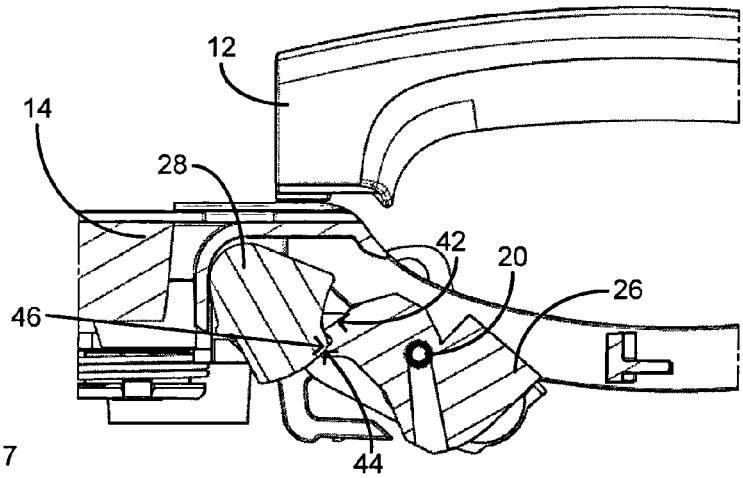
FIG. 7 is an underside view of an inertial catch and a countermass assembly of the vehicle door handle assembly of FIG. 6.

The transfer lever 18 includes or is coupled to a countermass assembly 26, as shown in FIGS. 2, 2A, and 3, that also rotates about the shaft 20 in response to rotation of the door handle 12 (i.e., from a rest position to an active position). For example, when the door handle 12 is pulled away from the base 14, the countermass assembly 26 rotates in a clockwise position about the shaft 20, relative to the view shown in FIG. 3, from its rest position to its active position. Also, as shown in FIGS. 2, 2A, and 3, the door handle assembly 10 includes an inertial catch 28 that rotates about a second shaft 30 coupled to the base 14 (e.g., via bearings 32). This inertial catch 28 is held in a normal rest or unblocking position by a torsion spring 34 and is not affected by rotation of the door handle 12 or the countermass assembly 26. However, the inertial catch rotates in response to inertia forces acting upon the inertial catch, such as those caused by a vehicle crash. For example, inertial forces acting upon the vehicle can cause the inertial catch 28 to rotate in a counterclockwise position about the second shaft 30, relative to the view shown in FIG. 3, from the unblocking position toward a blocking position, as best shown in FIGS. 5 and 7.

When the inertial catch 28 is in the unblocking position (i.e., when no inertia forces are causing rotation of the inertial catch 28 into the blocking position), the inertial catch 28 allows free rotation of the countermass assembly 26. For example, as shown in FIG. 3, the inertial catch 28 and the countermass assembly 26 are positioned relative to each other so that there is free space 36 between the inertial catch 28 and the countermass assembly 26 to allow free rotation of the countermass assembly 26 when a user pulls the door handle 12 to open the door. However, the inertial catch 28 is positioned relative to the countermass assembly 26 so that its rotational movement path 38 intersects with the rotational movement path 40 of the countermass assembly 26 (i.e., when the inertial catch 28 reaches its blocking position, as shown in FIGS. 4-7).

As described above, inertia forces cause rotation of the inertial catch 28 toward its blocking position. Such inertia forces also inadvertently cause the door handle 12 to be pulled away from the base 14 toward its active position and, as a result, the transfer lever 18 and the countermass assembly 26 to rotate so that the latch release mechanism 16 moves toward its active position. If the latch release mechanism 16 were to reach its active position during such an event, the door may be inadvertently opened. However, during such an event, the countermass assembly 26 and the inertial catch 28 act as a locking mechanism to prevent the latch release mechanism 16 from reaching its active position. More specifically, the inertial catch 28, when rotated into its blocking position by inertia forces, will engage and stop rotation of the countermass assembly 26 before the latch release mechanism 16 reaches its active position, therefore preventing the door from being opened.

Figure 5:
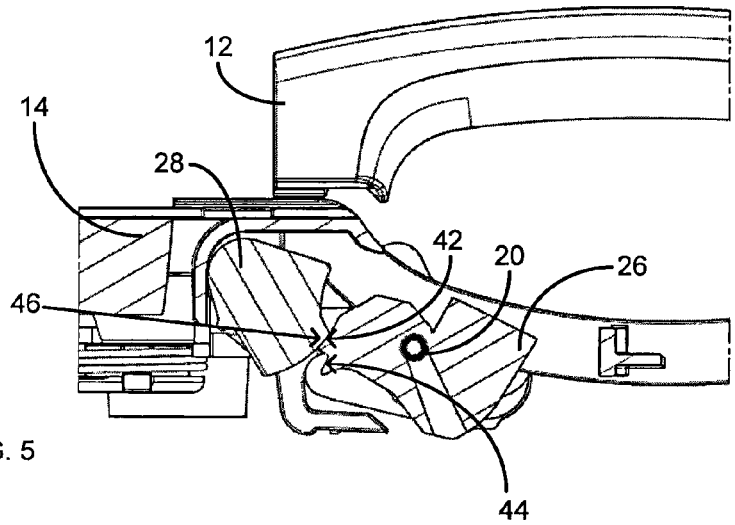
FIG. 5 is an underside view of an inertial catch and a countermass assembly of the vehicle door handle assembly of FIG. 4.
Figure 4:
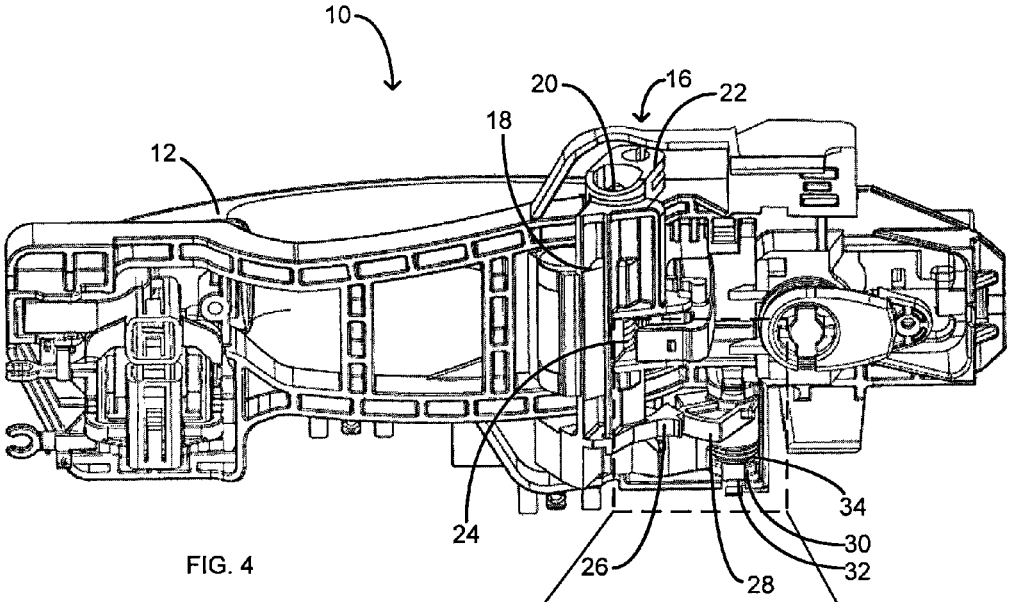
FIG. 4 is a perspective rear view of a vehicle door handle assembly in a primary blocked position and FIG. 4A is a detailed view of an area outlined by the dashed box in FIG. 4.
Figure 4A:
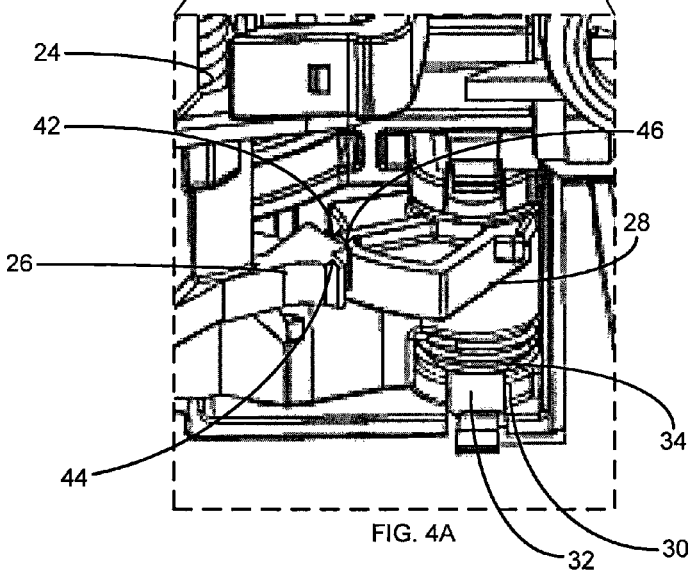

As shown in FIGS. 2-7, the countermass assembly 26 includes a primary catch point 42 and a secondary catch point 44. When in its blocking position, the inertial catch 28, and specifically a blocking shoulder 46 of the inertial catch 28, will engage either the primary catch point 42 or the secondary catch point 44 when the countermass assembly 26 rotates toward its active position. More specifically, in some crash events, inertia forces (e.g., within a first range, direction, and/or set of directions) cause the inertial catch 28 to rotate relative to the countermass assembly 26 at substantially the same rotation rate as the countermass assembly 26. In such events, the blocking shoulder 46 engages the countermass assembly 26 at the primary catch point 42 (e.g., a shoulder), as shown in FIGS. 4, 4A, and 5, to prevent the countermass assembly 26 from rotating into its active position. Thus, the door handle assembly 10, as illustrated in FIGS. 4 and 5, is engaged in a primary blocked position.

Figure 6:
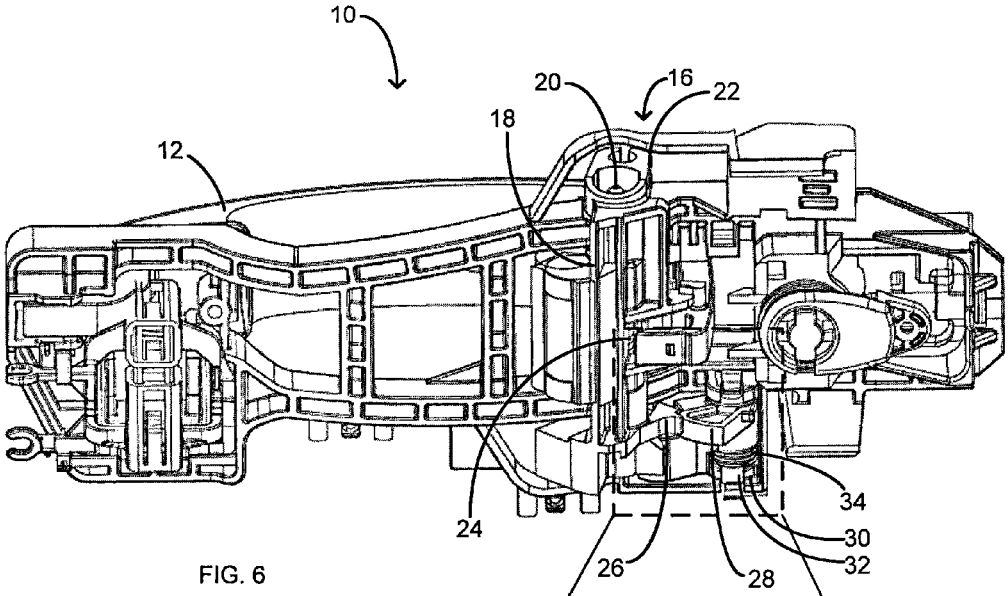
FIG. 6 is a perspective rear view of a vehicle door handle assembly in a secondary blocked position and FIG. 6A is a detailed view of an area outlined by the dashed box in FIG. 6.
Figure 6A:
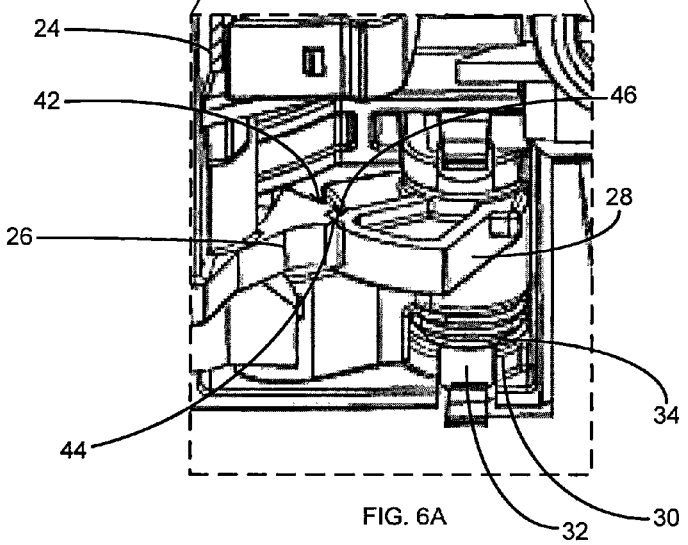

In other crash events, such as high-acceleration impact or rollover crash events, inertia forces (e.g., within a second range, direction, and/or set of directions) cause the countermass assembly 26 to rotate faster than the inertial catch 28, and as a result, the inertial catch 28 does not rotate fast enough for the blocking shoulder 46 to engage the countermass assembly 26 at the primary catch point 42. In conventional door handle assemblies, this allows free rotation of the latch release mechanism 16 into its active position and inadvertent door opening. In the present invention, however, the blocking shoulder 46 will still engage the secondary catch point 44 (e.g., a shoulder or step portion), as shown in FIGS. 6, 6A, and 7, to prevent the countermass assembly 26 from rotating into its active position. As a result, even if the countermass assembly 26 bypasses the inertial catch 28 at the primary catch point 42, the inertial catch 28 will still block rotation of the countermass assembly 26 by engaging the secondary catchpoint 44. Thus, the door handle assembly 10, as illustrated in FIGS. 6 and 7, is engaged in a secondary blocked position. Accordingly, the present invention provides a second opportunity to make the blocking contact and thus prevent rotation of the latch release mechanism 16 to its active position.

Thus, inertia forces during a vehicle crash cause the inertial catch 28 to block rotation of the countermass assembly 26 into its active position by engaging the primary catch point 42 or the secondary catch point 44. Once the inertia forces are no longer acting on the vehicle, or reach a low enough magnitude, the torsion springs 24, 34 cause the latch release mechanism 16 and the inertial catch 28 to rotate back to the rest position and the unblocking position, respectively.

While there has been shown and described what are at present considered the preferred embodiments of the invention, it will be obvious to those skilled in the art that various changes and modifications can be made therein without departing from the scope of the invention defined by the appended claims.

We claim:

1. An outer door handle assembly for a vehicle comprising:

a base;

a latch release mechanism including a countermass assembly having a primary catch point and a secondary catch point, said latch release mechanism and said countermass assembly rotatable about a first shaft coupled to said base between a rest position and an active position in response to movement of a door handle;

an inertial catch including a blocking shoulder, said inertial catch rotatable about a second shaft coupled to said base from an unblocking position to a blocking position in response to inertial forces acting upon said inertial catch; and wherein an axis of rotation of the countermass assembly is parallel with an axis of rotation of the inertial catch and wherein, when said inertial catch is moved into said blocking position in response to inertial forces acting upon said inertial catch, said blocking shoulder of said inertial catch is engageable with said countermass assembly at either one of said primary catch point or said secondary catch point depending on a rotational position of said countermass assembly when said inertial catch is moved into said blocking position to prevent said countermass assembly from rotating into said active position.

2. The outer door handle assembly of claim 1, wherein said inertial forces cause movement of said door handle and rotation of said countermass assembly from said rest position toward said active position.

3. The outer door handle assembly of claim 2, wherein said inertial forces include a first range of inertial forces causing said countermass assembly and said inertial catch to rotate at substantially the same rate, and causing said blocking shoulder to engage said primary catch point.

4. The outer door handle assembly of claim 2, wherein said inertial forces include a second range of inertial forces causing said countermass assembly to rotate faster than said inertial catch, and causing said blocking shoulder to engage said secondary catch point.

5. The outer door handle assembly of claim 1, wherein said inertial catch allows said countermass assembly to reach said active position when in said unblocking position.

6. The outer door handle assembly of claim 1, wherein said countermass assembly rotates along a first rotation path and said inertial catch rotates along a second rotation path, wherein said countermass assembly and said inertial catch are positioned relative to each other so that said first rotation path and said second rotation path intersect.

7. The outer door handle assembly of claim 1, further comprising a first spring applying spring forces to normally hold said countermass assembly in said rest position.

8. The outer door handle assembly of claim 1, further comprising a second spring applying spring forces to normally hold said inertial catch in said unblocking position.

9. The outer door handle assembly of claim 1, wherein said latch release mechanism releases latching mechanisms of a vehicle door when said countermass assembly is in said active position.

10. The outer door handle assembly of claim 1, wherein said first shaft is supported on said base by a first bearing, and said second shaft is supported on said base by a second bearing.

11. A locking mechanism for a door handle assembly comprising:

a countermass assembly having a primary catch point and a secondary catch point, said countermass assembly rotatable between a rest position and an active position; and an inertial catch including a blocking shoulder and rotatable between an unblocking position and a blocking position, wherein an axis of rotation of the countermass assembly is parallel with an axis of rotation of the inertial catch and said inertial catch being positionable relative to said countermass assembly so that, when said inertial catch is rotated to said blocking position, said inertial catch prevents said countermass assembly from rotating into said active position by engaging said countermass assembly at either one of said primary catch point or said secondary catch point depending on a rotational position of said countermass assembly when said inertial catch is moved into said blocking position.

12. The locking mechanism of claim 11, wherein said blocking shoulder engages one of said primary catch point and said secondary catch point based on a rate of rotation of said inertial catch relative to a rate of rotation of said countermass assembly.

13. The outer door handle assembly of claim 1, wherein, when said inertial catch is moved into said blocking position to engage either said primary catch point or said secondary catch point depending on said rotational position of said countermass assembly, said primary catch point is engagable with said blocking shoulder of the inertial catch at a first rotational position of said countermass assembly and said secondary catch point is engageable with the blocking shoulder of the inertial catch at a second rotational position of the countermass assembly that is different from the first rotational position.

14. The outer door handle assembly of claim 13, wherein said blocking position of said inertial catch member is the same in engagement with said countermass assembly at both the primary catch point and the secondary catch point.

15. The outer door handle assembly of claim 1, wherein said inertial forces acting upon said inertial catch are coincident with inertial forces acting on the countermass assembly.

16. The outer door handle assembly of claim 1, wherein said inertial forces acting upon said inertial catch are not coincident with inertial forces acting on the countermass assembly.

17. The locking mechanism of claim 11, wherein, when said inertial catch is moved into said blocking position to engage either said primary catch point or said secondary catch point depending on said rotational position of said countermass assembly, said primary catch point is engageable with said blocking shoulder of the inertial catch at a first rotational position of said countermass assembly and said secondary catch point is engageable with the blocking shoulder of the inertial catch at a second rotational position of the countermass assembly that is different from the first rotational position.

18. The locking mechanism of claim 17, wherein said blocking position of said inertial catch member is the same in engagement with said countermass assembly at both the primary catch point and the secondary catch point.

* * * * *